United States Patent [19]

Hinata et al.

[11] 4,135,933

[45] Jan. 23, 1979

[54] SILVER HALIDE PHOTOGRAPHIC EMULSION

[75] Inventors: Masanao Hinata; Haruo Takei; Akira Sato; Atsuo Iwamoto; Jun Hayashi, all of Minami-ashigara, Japan

[73] Assignee: Fuji Photo Film Co., Ltd., Minami-ashigara, Japan

[21] Appl. No.: 856,449

[22] Filed: Dec. 1, 1977

Related U.S. Application Data

[63] Continuation-in-part of Ser. No. 699,008, Jun. 21, 1976, abandoned.

[30] Foreign Application Priority Data

Jun. 20, 1975 [JP] Japan ..... 50/76163

[51] Int. Cl.$^2$ ..... G03C 1/40; G03C 1/14

[52] U.S. Cl. ..... 96/100 R; 96/124

[58] Field of Search ..... 96/124, 100, 137

[56] References Cited

U.S. PATENT DOCUMENTS

| | | | |
|---|---|---|---|
| 3,632,349 | 1/1972 | Shiba et al. | 96/124 |
| 3,922,170 | 11/1975 | Shiba et al. | 96/124 |
| 3,932,186 | 1/1976 | Borror et al. | 96/124 |

*Primary Examiner*—J. Travis Brown

*Attorney, Agent, or Firm*—Sughrue, Rothwell, Mion, Zinn and Macpeak

[57] ABSTRACT

A supersensitized silver halide photographic emulsion containing a cyan coupler and, in combination, at least one of the sensitizing dyes represented by the following general formula (I) and at least one of the sensitizing dyes represented by the general formula (II):

General Formula (I)

wherein $W^1$ and $W^2$ each represents a hydrogen atom, an alkyl group, an alkoxyl group, a halogen atom, an alkoxycarbonyl group, an acyl group or an aryl group; $R^1$ and $R^2$ each represents a sulfoalkyl group; $R^3$ represents an alkyl group or an allyl group; $X_1$ represents an acid anion; and m is 1 or 2, m being 1 in the case that the dye forms an inner salt of a betaine-like structure;

General Formula (II)

wherein $Z^1$ and $Z^2$ each represents an atomic group required for forming a benzothiazole nucleus, a benzoselenazole nucleus, a β-naphthothiazole nucleus or a β-naphthoselenazole nucleus; $R^4$ and $R^5$ each represents an aliphatic group and at least one of $R^4$ and $R^5$ represents a carboxyalkyl group or a sulfoalkyl group; $R^6$ represents an alkyl group, an aryl group, a thienyl group or a furyl group; $X_2$ represents an acid anion; and n is 1 or 2, n being 1 in the case that the dye forms an inner salt of a betaine-like structure.

10 Claims, No Drawings

SILVER HALIDE PHOTOGRAPHIC EMULSION

CROSS-REFERENCE TO RELATED APPLICATIONS

This application is a continuation-in-part application of copending application, Ser. No. 699,008, filed June 21, 1976, now abandoned.

BACKGROUND OF THE INVENTION

1. Field of the Invention

This invention relates to a silver halide photographic emulsion containing a cyan coupler which is spectrally sensitized with at least two types of sensitizing dyes having a supersensitizing effect on each other, more particularly, to a silver halide photographic emulsion which has increased spectral sensitivity in the red wavelength region.

2. Description of the Prior Art

It is well known as a technique of preparing photographic light-sensitive materials to extend the light-sensitive wavelength region of a silver halide photographic emulsion toward the longer wavelength side by adding a certain cyanine dye to the emulsion, i.e., to spectrally sensitize the emulsion. This spectral sensitivity is influenced by the chemical structure of the sensitizing dye added and by various characteristics of the emulsion, for example, the halogen composition of the silver halides, the crystal habit, the crystal system, the silver ion concentration, the hydrogen ion concentration, or the like. Moreover, the spectral sensitivity is influenced by photographic additives present in the emulsion such as a stabilizer, an anti-fogging agent, a coating aid, a flocculating agent or color couplers.

For the sensitization of a light-sensitive material in a certain spectral wavelength region, only one sensitizing dye is generally used. The combined use of sensitizing dyes often provides a spectral sensitivity lower than those obtained with the individual use of the sensitizing dyes. However, in special cases, a super-additive marked increase in spectral sensitivity is obtained when a certain sensitizing dye is used in combination with one or more other sensitizing dyes. This effect is known as supersensitization. However, strict selection is required in combining the sensitizing dye groups. Even a slight difference in chemical structure significantly affects the supersensitizing effect, and, therefore, it is difficult to predict a combination of sensitizing dyes having a supersensitizing effect based only on their chemical structural formulae.

Furthermore, the sensitizing effect on a particular emulsion can be varied by changing the nature of the emulsion. For example, the sensitizing effect can be enhanced by increasing the silver ion concentration and/or decreasing the hydrogen ion concentration. Therefore, the sensitizing effect can be increased by immersing a film coated with the spectrally sensitized emulsion in water or an aqueous solution of ammonia. The above manner of changing the sensitivity of the sensitized emulsion by increasing the silver ion concentration and/or decreasing the hydrogen ion concentration is usually referred to as hypersensitization. The shelf life of hypersensitized emulsions is generally short.

When supersensitization is applied to a silver halide photographic emulsion, the sensitizing dyes used must not adversely interact with photographic additives other than the sensitizing dyes and stable photographic properties must be maintained during storage of the light-sensitive material. Another requirement for the sensitizing dyes used is that no residual color remain on the processed light-sensitive material due to the sensitizing dyes. It is particularly required that no residual color remain in the case of short-time processing (usually taking several seconds to several tens of seconds) such as rapid processing.

In order to obtain excellent color reproducibility in a color light-sensitive material, it is not desired that the red-sensitive layer possess high sensitivity for too long a wavelength, for example, has a maximum sensitization at a wavelength longer than 660 nm, or that it possess sensitivity only in too short a wavelength region, for example, has a maximum sensitization at a wavelength shorter than 580 nm. Unfortunately, it is difficult with spectral sensitization techniques to selectively increase sensitivity in the wavelength region ranging from about 580 nm to about 630 nm, and, therefore, to solve this problem is one important object in the art.

SUMMARY OF THE INVENTION

Therefore, a first object of this invention is to provide a spectrallly sensitized silver halide photographic emulsion which has high sensitivity in the red wavelength region and where scarcely any residual sensitizing dye color remains.

A second object of this invention is to reduce the reduction in the sensitivity which occurs when a cyan coupler is used.

Another object of this invention is to provide sensitizing dyes which, when used for selectively spectrally sensitizing one layer of a light-sensitive material having a multilayer constitution so as to meet the objects of this invention, do not sensitize the adjacent light-sensitive layer by diffusing thereinto.

A further object of this invention is to provide sensitizing dyes which do not show a remarkable change in sensitivity with the lapse of time from the production of the light-sensitive material.

The above objects are accomplished by incorporating into a silver halide photographic emulsion containing a cyan coupler the combination of at least one benzimidazolothiacarbocyanine dye represented by the following general formula (I) and at least one carbocyanine dye represented by the following general formula (II) in supersensitizing amounts into the silver halide photographic emulsion.

(The following cyanine dyes each form inherently a resonance structure.)

General Formula (I)

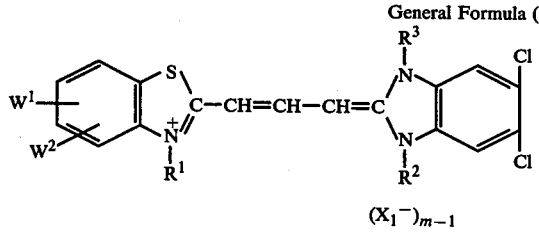

In this formula, $W^1$ and $W^2$ can each represent a hydrogen atom, an alkyl group, an alkoxy group, a halogen atom (such as fluorine, chlorine or bromine), an alkoxycarbonyl group, an acyl group or an aryl group. $R^1$ and $R^2$ can each represent a sulfoalkyl group. $R^3$ represents an alkyl group or an allyl group. $X_1$ represents an acid anion. *m* is 1 or 2, *m* being 1 in the case that the dye forms an inner salt (betaine-like structure). While not to be construed as limitative, of the above moieties most preferred for $W^1$ and $W^2$ are the following, when present: alkyl, alkoxy and alkoxy-carbonyl comprising up to 4 carbon atoms; acyl groups comprising up to 4 carbon atoms in the case of aliphatic acyl and up to 10 carbon atoms in the case of aromatic acyl; monocyclic aryl groups. For the case of $R^1$ and $R^2$, the following are most preferred; sulfoalkyl groups wherein the alkyl moiety has up to 8 carbon atoms. For $R^3$, most preferred when present are alkyl groups having up to 4 carbon atoms and allyl groups having up to 6 carbon atoms.

General Formula (II)

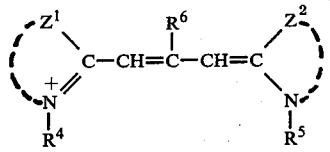

$(X_2^-)_{n-1}$

In this formula, $Z^1$ and $Z^2$ each represents an atomic group required to form a benzothiazole, benzoselenazole, β-naphthothiazole or β-naphthoselenazole nucleus, which nucleus may be substituted by a substituent such as halogen atom, an alkyl group, an alkoxy group, an acyl group or an alkoxy-carbonyl group. $R^4$ and $R^5$ can each represent an aliphatic group, and at least one of $R^4$ and $R^5$ represents a sulfoalkyl group or a carboxyalkyl group. $R^6$ represents an alkyl group, an aryl group, a thienyl group or a furyl group. $X_2$ represents an acid anion. $n$ is 1 or 2, $n$ being 1 in the case that the dye forms an inner salt (betaine-like structure). While not to be construed as limitative, most preferred $R^4$ and $R^5$ groups, when present, are those aliphatic groups having up to 10 carbon atoms, and when $R^4$ and/or $R^5$ are sulfoalkyl or carboxyalkyl, it is most preferred that the alkyl moiety thereof have up to 8 carbon atoms. On the other hand, it is most preferred that $R^6$, when an alkyl group, have up to 4 carbon atoms, and when an aryl group, $R^6$ be a monocyclic aryl group.

DETAILED DESCRIPTION OF THE INVENTION

Preferred examples of the above substituents in general formulae (I) and (II) representing the sensitizing dyes used in this invention are given below.

$W^1$ and $W^2$ each represents a hydrogen atom, an alkyl group (such as methyl, ethyl or propyl), an alkoxy group (such as methoxy, ethoxy or propoxy), an alkoxycarbonyl group (such as methoxycarbonyl, ethoxycarbonyl or propoxycarbonyl), an acyl group (such as acetyl, propionyl or butyryl), an aryl group (such as phenyl) or a halogen atom (such as fluorine, chlorine or bromine). $R^3$ represents an alkyl group (including unsubstituted alkyl groups and substituted alkyl groups wherein the substituent is hydroxyl, alkoxycarbonyl and the like; e.g., methyl, ethyl, propyl, hydroxyethyl, hydroxypropyl or methoxycarbonylethyl) or an allyl group (such as vinylmethyl). $Z^1$ and $Z^2$ can each represent a benzothiazole, 5-chlorobenzothiazole, 5-bromobenzothiazole, 5-methylbenzothiazole, 5-methoxybenzothiazole, 5-ethoxybenzothiazole, 5-carboxybenzothiazole, 5-methoxycarbonylbenzothiazole, 5-ethoxycarbonylbenzothiazole, 5-phenylbenzothiazole, 5-acetylbenzothiazole, 5-propionylbenzothiazole, 5-hydroxybenzothiazole, 5-trifluoromethylbenzothiazole, 5-cyanobenzothiazole, 5-chlorobenzothizaole, 6-methoxybenzothiazole, 6-ethoxybenzothiazole, 6-methylbenzothiazole, 5,6-dimethylbenzothiazole, 5,6-dichlorobenzothiazole, 5,6-dimethoxybenzothiazole, 5-methoxy-6-methylbenzothiazole, 5-methyl-6-methoxybenzothiazole, naphtho[1,2-d]-thiazole, benzoselenazole, 5-chlorobenzoselenazole, 5-bromobenzoselenazole, 5-methylbenzoselenazole, 5-methoxybenzoselenazole, 5-ethoxybenzoselenazole, 5-carboxybenzoselenazole, 5-methoxycarbonylbenzoselenazole, 5-ethoxycarbonylbenzoselenazole, 5-phenylbenzoselenazole, 5-acetylbenzoselenazole, 5-propionylbenzoselenazole, 5-hydroxybenzoselenazole, 5-cyanobenzoselenazole, 5-trifluoromethylbenzoseleanzole, 6-chlorobenzoselenazole, 6-methoxybenzoselenazole, 6-methylbenzoselenazole, 5,6-dimethylbenzoselenazole, 5,6-dimethoxybenzoselenazole, 5-methoxy-6-methylbenzoselenazole, 5-methyl-6-methoxybenzoselenazole or naphtho[1,2-d]selenazole.

$R^1$ and $R^2$ each represents a sulfoalkyl group (such as 2-sulfoethyl, 3-sulfopropyl, 3-sulfobutyl, 4-sulfobutyl, 2-(3-sulfopropoxy)ethyl, 2-hydroxy-3-sulfopropyl or 3-sulfopropoxyethoxyethyl). $R^4$ and $R^5$ can each represent a methyl group, an ethyl group, a propyl group, a hydroxyalkyl group (such as 2-hydroxyethyl, 3-hydroxypropyl or 4-hydroxybutyl), a carboxyalkyl group (such as 2-carboxyethyl, 3-carboxypropyl or 4-carboxybutyl), 2-(2carboxyethoxy)ethyl group, a sulfoalkyl group (such as 2-sulfoethyl, 3-sulfopropyl, 3-sulfobutyl, 4-sulfobutyl, 2-(3-sulfopropoxy)ethyl, 2-hydroxy-3-sulfopropyl or 3-sulfopropoxyethoxyethyl) or a vinylmethyl group.

$R^6$ represents a methyl group, an ethyl group, a propyl group, a phenyl group, a benzyl group, a phenethyl group, a thienyl group or a furyl group.

$X_1$ and $X_2$ can each represent an acid anion as is used for conventional cyanine dye salts such as an iodide, bromide, chloride, p-toluenesulfonate, benzenesulfonate, sulfate, perchlorate or thiocyanate ion.

The compounds represented by the above general formulae (I) and (II) can be easily synthesized by one skilled in the art with reference to British Pat. Nos. 403,845, 742,112, 1,328,239 and 1,327,808, U.S. Pat. Nos. 2,503,776 and 3,196,017, and German Pat. No. 1,072,765.

Of the compounds represented by the above general formulae (I) and (II), the compounds represented by the following general formulae are advantageously used in this invention.

General Formula (I-1)

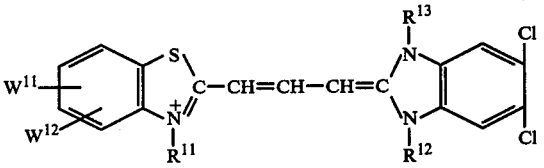

$(X_1^-)_{m-1}$

In this formula, $W^{11}$ and $W^{12}$ have the same meanings as $W^1$ and $W^2$ in general formula (I). $R^{13}$ represents a methyl group, an ethyl group, a propyl group, a vinylmethyl group, a methoxycarbonylethyl group, a hydroxyethyl group or a hydroxypropyl group. $R^{11}$ and $R^{12}$ each represents a sulfoalkyl group. $X_1$ and $m$ have the same meanings as $X_1$ and $m$ in general formula (I), respectively. While not to be construed as limitative, it is most preferred that $R^{11}$ and $R^{12}$, when sulfoalkyl, contain up to 8 carbon atoms in the alkyl moiety thereof.

General Formula (II-1)

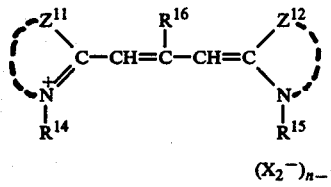

In this formula, $Z^{11}$ and $Z^{12}$ have the same meanings as $Z^1$ and $Z^2$ in general formula (II). $R^{16}$ represents a methyl group, an ethyl group, a propyl group, a phenyl group, a furyl group or a thienyl group. $R^{14}$ and $R^{15}$ can each represent a sulfoalkyl group or a carboxyalkyl group. $X_2$ and $n$ have the same meanings as $X_2$ and $n$ in general formula (II), respectively. While not to be construed as limitative, it is most preferred that when $R^{14}$ and $R^{15}$ are sulfoalkyl they contain no more than 8 carbon atoms in the alkyl moiety thereof, and when they are carboxyalkyl, they contain no more than 4 carbon atoms in the alkyl moiety thereof.

Of the compounds represented by the above general formulae, particularly useful sensitizing dyes are represented by the following general formulae.

General Formula (I-2)

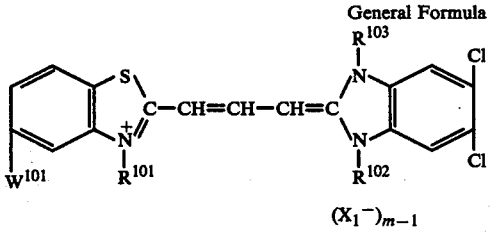

In this formula, $W^{101}$ represents a hydrogen atom, a chlorine atom, an alkyl group, an alkoxyl group, an acyl group or an alkoxycarbonyl group. $R^{101}$, $R^{102}$, $R^{103}$, $X_1$ and $m$ have the same meanings as $R^{11}$, $R^{12}$, $R^{13}$, $X_1$ and $m$ in the above-described general formula (I-1), respectively. While not to be construed as limitative, it is most preferred that $W^{101}$, when an alkyl group, contain up to 4 carbon atoms, when an alkoxy group, contain up to 4 carbon atoms, when aliphatic acyl, contain up to 4 carbon atoms, when aromatic acyl, contain up to 7 carbon atoms, and when alkoxycarbonyl, contain up to 4 carbon atoms.

General Formula (II-2)

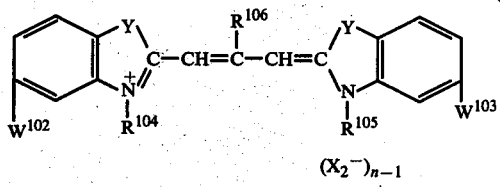

In this formula, Y represents a sulfur atom or a selenium atom. $W^{102}$ and $W^{103}$ can each represent a hydrogen atom, a halogen atom, an alkyl group, an alkoxyl group, an acyl group or an alkoxycarbonyl group. $R^{106}$ represents a methyl group, an ethyl group or a propyl group. $R^{104}$, $R^{105}$, $X_2$ and $n$ have the same meanings as $R^{14}$, $R^{15}$, $X_2$ and $n$ in general formula (II-1), respectively. While not to be construed as limitative, it is most preferred that $W^{102}$ and $W^{103}$, when alkyl, alkoxy or alkoxycarbonyl, contain up to 4 carbon atoms, when aliphatic acyl, contain up to 4 carbon atoms, and when aromatic acyl, contain up to 7 carbon atoms.

General Formula (II-3)

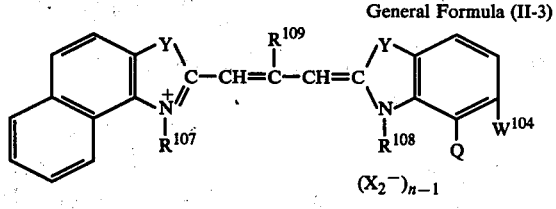

In this formula, Y represents a sulfur atom or a selenium atom. $W^{104}$ represents a hydrogen atom, an alkyl group, an alkoxy group or a halogen atom. Q represents a hydrogen atom or may form benzene nucleus in conjunction with $W^{104}$. $R^{109}$ represents a methyl group, an ethyl group, a propyl group or a phenyl group. $R^{107}$, $R^{108}$, $X_2$ and $n$ have the same meaning as $R^{14}$, $R^{15}$, $X_2$ and $n$ in general formula (II-1), respectively. While not to be construed as limitative, it is most preferred that when $W^{104}$ is an alkyl group it contains up to 4 carbon atoms and when an alkoxyl group it contains up to 4 carbon atoms.

Illustrative examples of the sensitizing dyes used in this invention are given in the following, but this invention is not limited only to these examples.

Illustrative examples of dyes represented by the general formula (I):

(I-1)

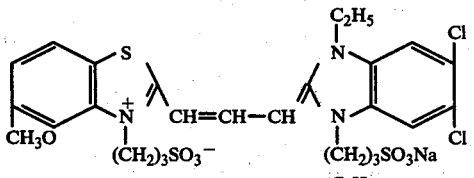

(I-2)

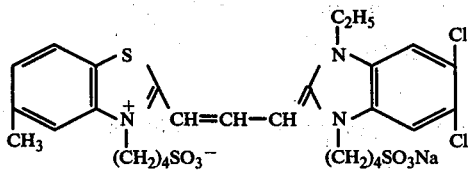

-continued
(I-3)
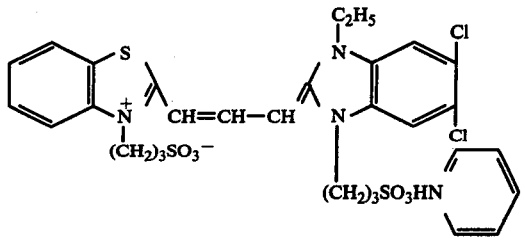
(I-4)
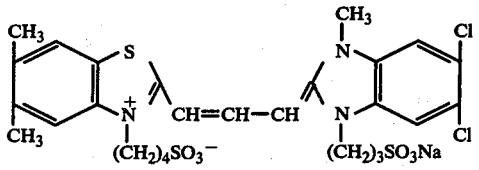
(I-5)
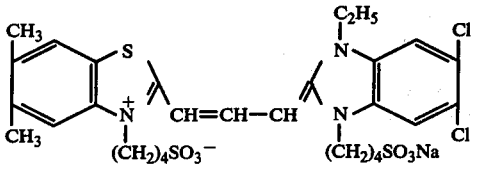
(I-6)
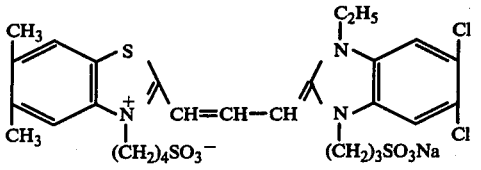
(I-7)
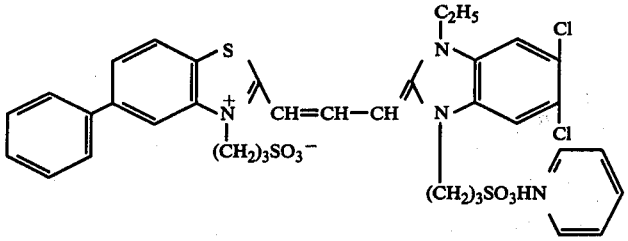
(I-8)
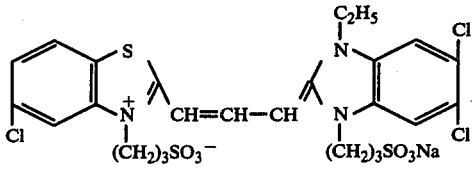
(I-9)
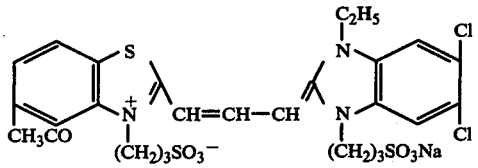
(I-10)
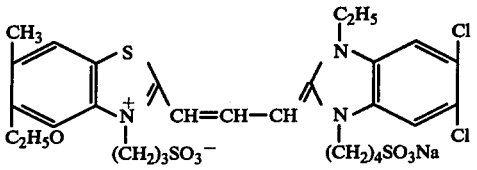
(I-11)
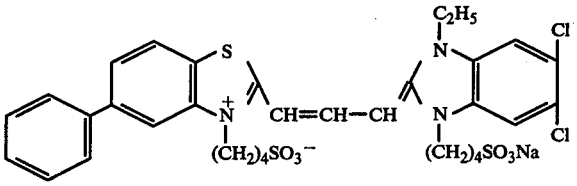
Illustrative examples of dyes represented by the general formula (II):

(II-1)
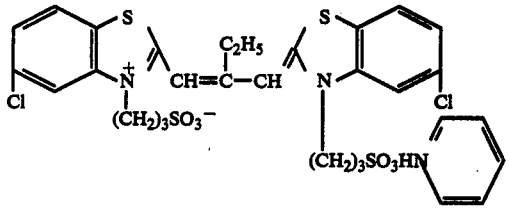
(II-2)
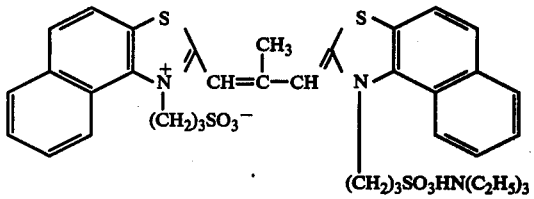
(II-3)
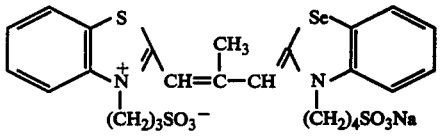
(II-4)
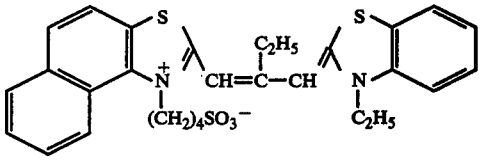
(II-5)
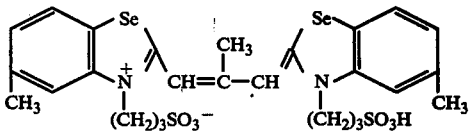
(II-6)
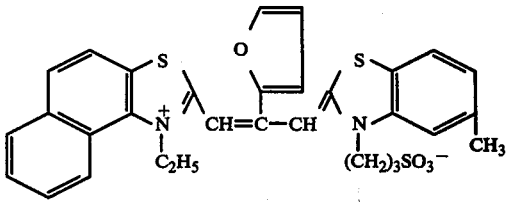
(II-7)
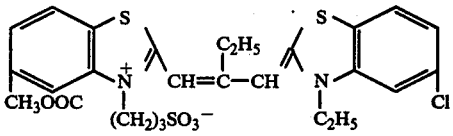
(II-8)
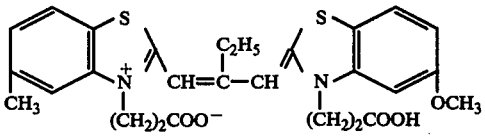
(II-9)
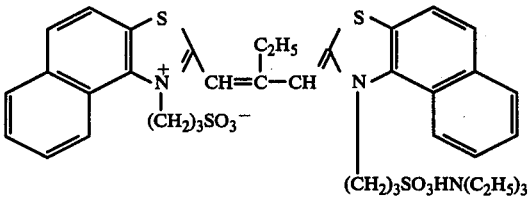

-continued
(II-10)
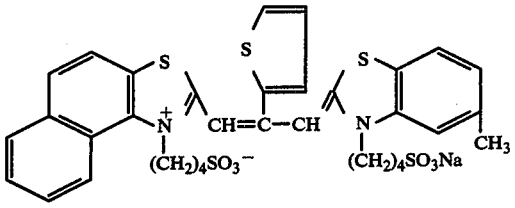
(II-11)
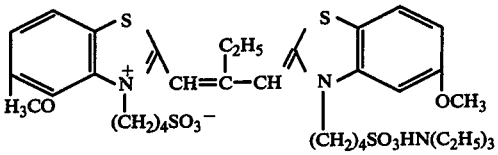
(II-12)
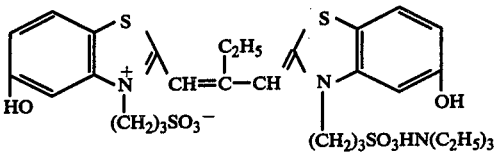
(II-13)
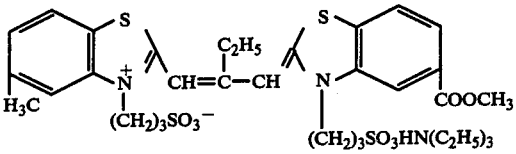
(II-14)
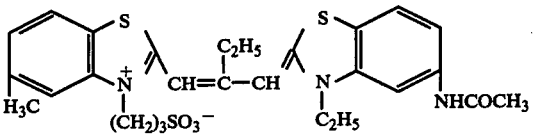
(II-15)
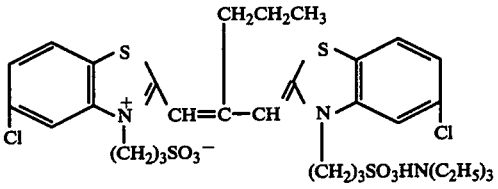
(II-16)
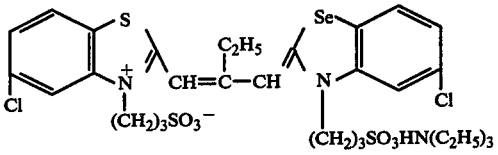
(II-17)
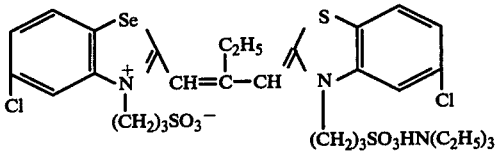
(II-18)
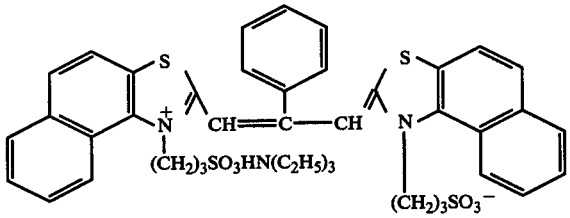

-continued
(II-19)
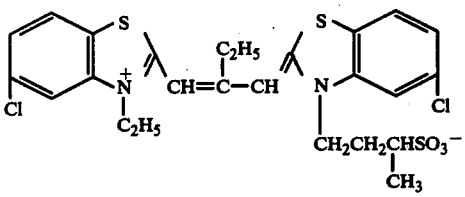
(II-20)
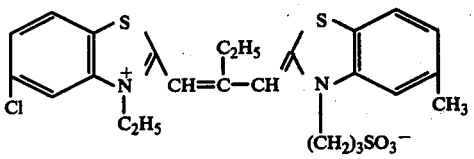
(II-21)
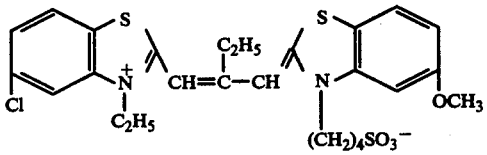
(II-22)
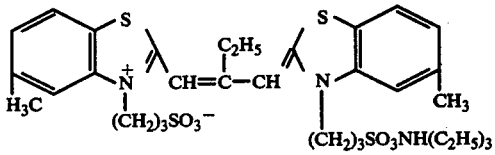
(II-23)
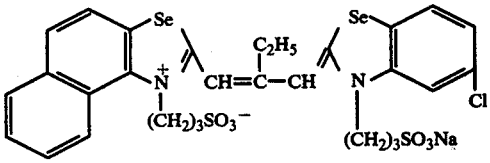
(II-24)
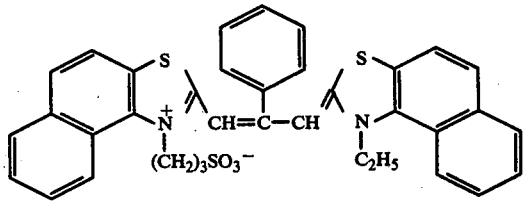
(II-25)
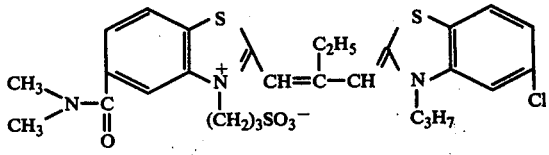
(II-26)
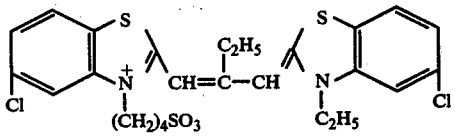
(II-27)
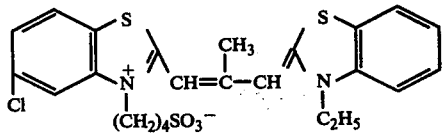
(II-28)
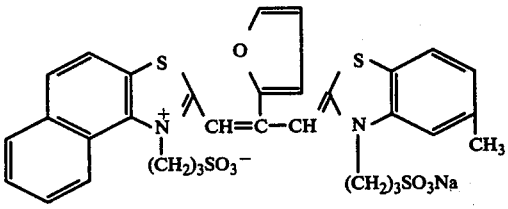
Dyes used herein for the purposes of comparison:

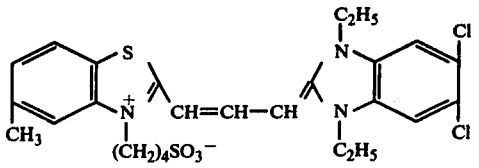
Dye (A)
(disclosed in U.S. Pat. No. 3,932,196)
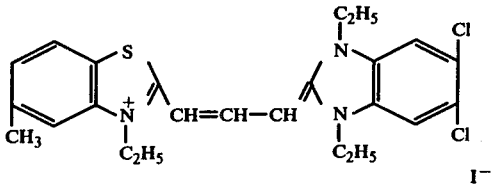
Dye (B)
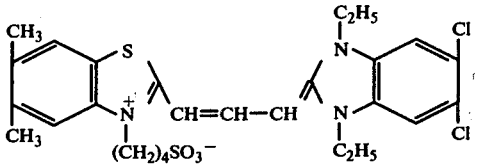
Dye (C)
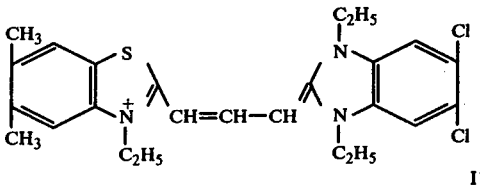
Dye (D)
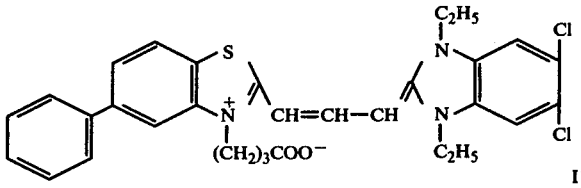
Dye (E)
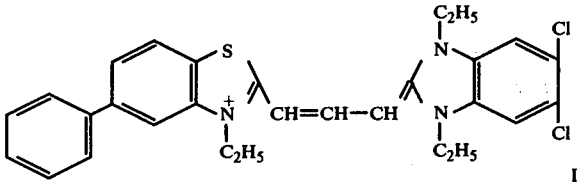
Dye (F)
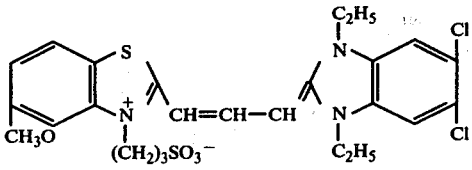
Dye (G)
(disclosed in U.S. Pat. No. 3,932,186)
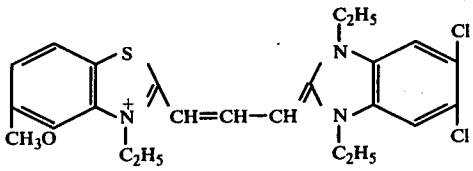
Dye (H)
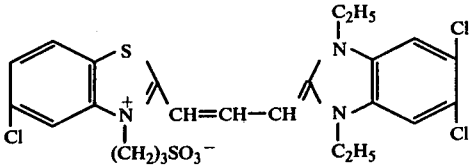
Dye (J)
(disclosed in U.S. Pat. No. 3,932,186)

-continued

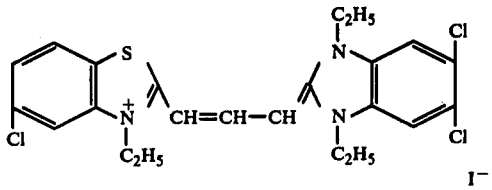

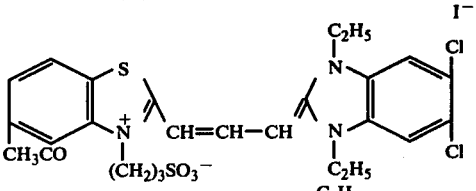

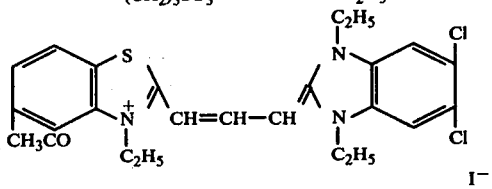

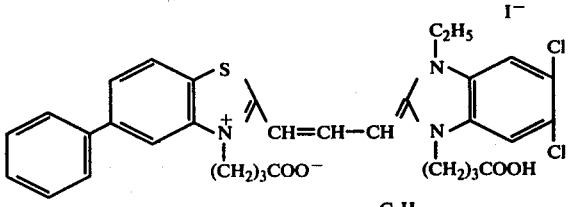

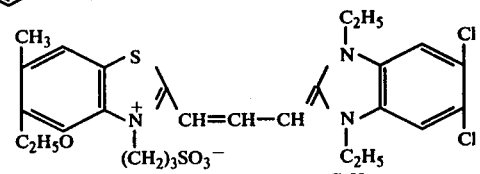

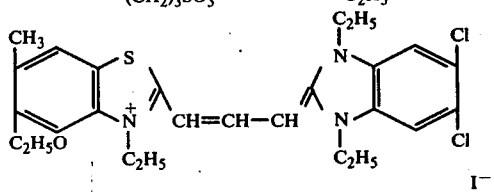

Particularly preferred compounds of this invention are the compounds of the general formula (I-2) in which $W^{101}$ represents an alkyl group, an alkoxyl group or an acyl group each having up to 4 carbon atoms, and $R^{101}$ and $R^{102}$, respectively, represent a sulfoalkyl group having up to 4 carbon atoms, the compounds of the general formula (II-2) in which $W^{102}$ represents a hydrogen atom, a chlorine atom, or an alkyl group, an alkoxyl group, an acyl group or an alkoxycarbonyl group each having up to 4 carbon atoms, and $R^{104}$ and $R^{105}$, respectively, represent a sulfoalkyl group or a carboxyalkyl group each having up to 4 carbon atoms, and compounds of the general formula (II-3) in which $W^{104}$ represents a hydrogen atom, a chlorine atom, or an alkyl group or an alkoxyl group each having up to 4 carbon atoms, or Q and $W^{104}$ form a benzene nucleus, and $R^{107}$ and $R^{108}$, respectively, represent a sulfoalkyl group or a carboxyalkyl group each having up to 4 carbon atoms.

Each of the compound(s) represented by the general formula (I) and the compound(s) represented by the general formula (II) are incorporated in a silver halide photographic emulsion in an amount of about $1 \times 10^{-6}$ to about $5 \times 10^{-3}$ mol, preferably $1 \times 10^{-5}$ to $2.5 \times 10^{-3}$ mol, and particularly preferably $4 \times 10^{-5}$ to $1 \times 10^{-3}$ mol, per mol of silver halide. The molar ratio of the dye(s) of the general formula (II) to the dye of the general formula (I) used is preferably about 1:10 to about 20:1, particularly 1:2 to 10:1.

The silver halide photographic emulsion used in this invention is prepared by conventional methods. It can contain grains of silver chloride, silver bromide, silver iodide or mixed silver halides precipitated and ripened, for example, by a single jet method or by a double jet method or by using a combined method thereof. Preferred silver halides are silver bromoiodide, silver chlorobromide and silver chlorobromoiodide. The silver halide(s) used may be either of a finely divided particle size or of a coarse particle size. The average diameter of the grains (e.g., as measured by the projected area method in number average) is preferably 0.04 $\mu$ to 4 $\mu$.

The silver halide photographic emulsion used in this invention can be subjected to conventional chemical sensitizing methods such as gold sensitization (as described in U.S. Pat. Nos. 2,399,083, 2,540,085, 2,597,856 and 2,597,915), sensitization using metal ions of Group VIII (as described in U.S. Pat. Nos. 2,448,060, 2,540,086, 2,566,245, 2,566,263 and 2,598,079), sulfur sensitization (as described in U.S. Pat. Nos. 1,574,944, 2,278,947, 2,440,206, 2,410,689, 3,189,458 and 3,415,649), reduction sensitization (as described in U.S.

Pat. Nos. 2,518,698, 2,419,974 and 2,983,610) or various combined sensitizing methods thereof.

Specific examples of chemical sensitizers which can be contained are sulfur sensitizers such as allylthiocarbamide, thiourea, sodium thiosulfate or cystine; noble metal sensitizers such as potassium chloroaurate, aurous thiosulfate or potassium chloropalladate; and reducing sensitizers such as stannous chloride, phenylhydrazine or reductone. Moreover, sensitizers such as polyoxyethylene compounds, polyoxypropylene compounds or compounds having a quaternary ammonium group can be present.

Various compounds can be added to the photographic emulsion of this invention in order to prevent a lowering of sensitivity and the occurrence of fog in the production steps of the light-sensitive material, during the storage thereof or in the course of processing. Many such compounds have long been known, for example, nitrobenzimidazole, ammonium chloroplatinate, 4-hydroxy-6-methyl-1,3,3a,7-tetrazaindene, 3-methylbenzothiazole or 1-phenyl-5-mercaptotetrazole, as well as many heterocyclic compounds, mercury containing compounds, mercapto compounds, metal salts, and the like. Examples of such compounds which can be used are described in C. E. K. Mees & T. H. James, *The Theory of the Photographic Process,* Third Ed., pp. 344 – 349 (1966) and the original references cited therein, and the following patents: U.S. Pat. Nos. 1,758,576, 2,110,178, 2,131,018, 2,173,628, 2,697,040, 2,304,962, 2,324,123, 2,394,198, 2,444,605 to 8, 2,566,245, 2,694,716, 2,697,099, 2,708,162, 2,728,663 to 5, 2,476,536, 2,824,001, 2,843,491, 3,052,544, 3,137,577, 3,220,839, 3,226,231, 3,236,652, 3,251,691, 3,252,799, 3,287,135, 3,326,681, 3,420,668 and 3,622,339, and British Pat. Nos. 893,428, 403,789, 1,173,609 and 1,200,188.

Hardening of the emulsion can be effected in a conventional manner, if desired. Examples of hardeners include aldehyde compounds such as formaldehyde or glutaraldehyde; ketone compounds such as diacetyl or cyclopentanedione; compounds having a reactive halogen such as bis(2-chloroethylurea), 2-hydroxy-4,6-dichloro-1,3,5-triazine or compounds as described in U.S. Pat. Nos. 3,288,775 and 2,732,303, and British Pat. Nos. 974,723 and 1,167,207; compounds having a reactive olefin such as divinyl sulfone, 5-acetyl-1,3-diacryloylhexahydro-1,3,5-triazine or compounds as described in U.S. Pat. Nos. 3,635,718 and 3,232,763, and British Pat. No. 994,869; N-methylol compounds such as N-hydroxymethylphthalimide or compounds as described in U.S. Pat. Nos. 2,732,316 and 2,586,168; isocyanates as described in U.S. Pat. Nos. 3,103,437; aziridine compounds as described in U.S. Pat. Nos. 3,017,280 and 2,983,611; acid derivatives as described in U.S. Pat. Nos. 2,725,294 and 2,725,295; carbodiimide compounds as described in U.S. Pat. No. 3,100,704; epoxy compounds as described in U.S. Pat. No. 3,091,537; isoxazole compounds as described in U.S. Pat. Nos. 3,321,313 and 3,543,292; halocarboxyaldehydes such as mucochloric acid; dioxane derivatives such as dihydroxydioxane or dichlorodioxane; and inorganic hardeners such as chrome alum or zirconium sulfate. Moreover, in place of the above compounds, those in the form of precursors thereof such as alkali metal bisulfite aldehyde adducts, methylol derivatives of hydantoin or primary aliphatic nitroalcohols can be used.

The photographic emulsion of this invention can contain surface active agents alone or as a mixture thereof, if desired. The surface active agents are used as a coating aid but they can sometimes be used for other purposes, for example, for improving emulsification, sensitization or photographic properties, for imparting antistatic or anti-adhesion properties, etc. These surface active agents are divided into natural surface active agents such as saponin, nonionic surface active agents such as alkylene oxides, glycerols or glycidols, cationic surface active agents such as higher alkylamines, quaternary ammonium salts, pyridine or other heterocyclic rings, phosphoniums or sulfoniums, anionic surface active agents containing an acid group such as a carboxylic acid, sulfonic acid, phosphoric acid, sulfuric ester group or phosphoric ester group, and amphoteric surface active agents such as amino acids, aminosulfonic acids, or sulfuric or phosphoric esters of aminoalcohols.

The surface active agents which can be used are described, e.g., in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, German Pat. No. 1,942,665, British Pat. Nos. 1,077,317 and 1,198,450 as well as in Ryohei Oda, et al., *Synthesis of Surface Active Agents and Their Applications,* Maki Publisher (1964), A. W. Schwartz, *Surface Active Agents,* Interscience Publications Inc. (1958), and J. P. Sisley, *Encyclopedia of Surface Active Agents, Vol.* 2, Chemical Publishing Company (1964).

The silver halide photographic emulsion used in this invention can contain, as a protective colloid, in addition to or in place of gelatin, acylated gelatin such as phthalated gelatin or malonated gelatin; cellulose compounds such as hydroxyethyl cellulose or carboxymethyl cellulose; soluble starches such as dextrin; and hydrophilic polymers such as polyvinyl alcohol, polyvinyl pyrrolidone, polyacrylamide or polystyrenesulfonic acid, a plasticizer for dimensional stabilization, a latex polymer and a matting agent. The finished emulsion is coated on a suitable support, for example, baryta paper, resin coated paper, synthetic paper, triacetate film, polyethylene terephthalate film, other plastic bases or a glass sheet.

The sensitizing dyes used in this invention are added in the form of aqueous solutions or solutions dissolved in a water miscible organic solvent such as methanol, ethanol, methyl Cellosolve or pyridine.

The sensitizing dyes may be dissolved by means of supersonic vibrations as described in U.S. Pat. No. 3,485,634. Other methods of dissolving or dispersing the sensitizing dyes of this invention and adding the same to the emulsion can also be used which are described in U.S. Pat. Nos. 3,482,981, 3,585,195, 3,469,987, 3,425,835 and 3,342,605, British Pat. Nos. 1,271,329, 1,038,029 and 1,121,174, and U.S. Pat. Nos. 3,660,101 and 3,658,546. Moreover, the method described in German Patent Application (OLS) No. 2,104,283 and the method described in U.S. Pat. No. 3,649,286 can be used.

The silver halide photographic emulsion of this invention can contain color couplers and compounds used for dispersing them.

Of the color couplers which can be contained, cyan couplers are particularly preferred.

The cyan couplers useful in the practice of the present invention may be represented by the general formula (III) or (IV)

General Formula (III)

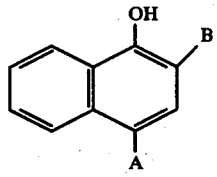

General Formula (IV)

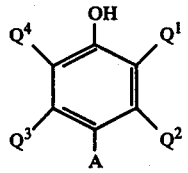

wherein B represents a substituent generally used for cyan couplers such as, for instance, a carbamyl group (e.g., an alkylcarbamyl group, an arylcarbamyl group such as a phenylcarbamyl group, a heterocyclic carbamyl group such as a benzothiazolylcarbamyl group, etc.), a sulfamyl group (e.g., an alkylsulfamyl group, an arylsulfamyl group such as a phenylsulfamyl group, a heterocyclic sulfamyl group, etc.), an alkoxycarbonyl group, and an aryloxycarbonyl group; $Q^1$ represents an alkyl group, an aryl group, a heterocyclic group, an amino group (e.g., an amino group, an alkylamino group, an arylamino group, etc.), a carbonamido group (e.g., an alkylcarbonamido group, an arylcarbonamido group, a heterocyclic carbonamido group, etc.), a sulfonamido group, a sulfamyl group (e.g., an alkylsulfamyl group, an arylsulfamyl group, etc.), or a carbamyl group; $Q^2$, $Q^3$ and $Q^4$ each represents the groups as defined for $Q^1$, and further, a halogen atom, or an alkoxy group; and A represents a hydrogen atom of a group which can be released by coupling.

The couplers used in this invention can be four-equivalent couplers or two-equivalent couplers used for conventional color photographic materials and they can also be uncolored couplers or colored couplers. For instance, A in general formulae (III) and (IV) represents a hydrogen atom or a group which can be released at coupling but is particularly preferably a group rendering the coupler a two-equivalent coupler.

A represents a hydrogen atom, a halogen atom (e.g., a chlorine atom, a bromine atom, etc.), an indazolyl group a cyclic imido group, an acyloxy group, an aryloxy group, an alkoxy group, a sulfo group, an arylazo group, and a heterocyclic azo group. Examples of these groups are described in the specifications of U.S. Pat. Nos. 2,423,730, 3,227,550 and 3,311,476 and British Pat. Nos. 1,084,480 and 1,165,563. Also, A can be a residue which can release a development inhibitor at development, such as an arylmonothio group (e.g., a phenylthio group, a 2-carboxyphenylthio group, etc.), a heterocyclic thio group, a 1-benzotriazolyl group, and a 1-benzodiazolyl group; and also the residues are described in German Patent Application (OLS) No. 2,414,006.

The couplers used in this invention can be colored couplers and examples of suitable colored couplers are described in, for instance, the specifications of U.S. Pat. Nos. 2,983,608, 3,005,712 and 3,034,892, British Pat. Nos. 937,021, 1,269,073, 586,211 and 627,814, and French Pat. Nos. 980,372, 1,091,903, 1,257,887, 1,398,308 and 2,015,649.

Specific examples of couplers which can be used in this invention are illustrated below but it is to be understood that the couplers in this invention are not to be construed as being limited to these couplers.

Coupler A 1-Hydroxy-N-[γ-(2,4-di-tert-amylphenoxypropyl)]-2-naphthamide

Coupler B 1-Hydroxy-4-[2-(2-hexyldecyloxycarbonyl)phenylazo]-2-[N-(1-naphthyl)]naphthamide Coupler C 1-Hydroxy-4-chloro-N-[α-(2,4-di-tert-amylphenoxy)butyl]-2-naphthamide Coupler D 5-Methyl-4,6-dichloro-2-[α-(3-n-pentadecylphenoxy)butyramido]phenol Coupler E 1-Hydroxy-4-iodo-N-dodecyl-2-naphthamide Coupler F 5-Methoxy-2-[α-(3-n-pentadecylphenoxy)butyramido]-4-(1-phenyl-5-tetrazolythio)phenol Further, phenol couplers as described in U.S. Pat. No. 2,698,794 and naphthol couplers as described in U.S. Pat. No. 2,474,293 are particularly useful.

Moreoer, couplers as described in U.S. Pat. No. 2,600,788, British Pat. No. 904,852 and Japanese Patent Application No. 6,031/65 and cyan couplers of the α-naphthol or phenol type, for example, compounds as described in U.S. Pat. Nos. 3,311,476, 3,458,315, 3,214,437 and 3,253,924 can be used.

Typical examples of colored couplers are those as described in Japanese Patent Publication No. 2,016/69, Japanese Patent Application No. 45,971/73 and U.S. Pat. Nos. 3,476,560, 3,034,892, 3,386,301, 2,434,272 and 3,476,564.

Typical DIR couplers are, for example, those as described in U.S. Pat. Nos. 3,148,062, 3,227,554, 3,701,783, 3,617,291 and 3,622,328, Japanese Patent Publication No. 28,836/70, Japanese Patent Application No. 33,238/73 and German Patent Application (OLS) No. 2,163,811.

The dyes combined for supersensitazation according to this invention are applied for the sensitization of various silver haldie photographic emulsions for color light-sensitive materials. Such emulsions are those used for various applications such as color positive film, color papers, color negative films, color reversal films (with couplers).

The following examples further illustrate this invention, but are not intended to limit the same. Unless otherwise indicated herein, all parts, percents, ratios and the like are by weight.

EXAMPLE 1

80 g of a cyan coupler (1-hydroxy-4-maleimide-2-naphthamide, described in British patent No. 1,165,563) was completely dissolved in a mixed solution of 100 cc of tricresyl phosphate and 50 cc of ethyl acetate. Further, 2 g of sorbitan monolaurate was dissolved therein. The resulting solution was added to 1 kg of a 10 wt% aqueous gelatin solution to which 2.5 g of dodecylbenzenesulfonic acid had been added as an aqueous solution, followed by high-speed stirring and supersonic agigation to obtain an emulsified product.

A silver bromoiodide emuslion (having an iodide content of 7 mol%) was prepared by precipitating silver halide grains by the double jet method and subjecting the same to physical ripening, desalting and chemical ripening by conventional methods. The average diameter of the silver halide grains contained in this emulsion was 0.7 micron. This emulsion contained 0.52 mol of the silver halide per kg of the emulsion.

This emulsion (1 kg) was weighed and placed in a pot, and dissolved in a constant temperature bath at 50° C. Methanol solutions of sensitizing dyes were respectively added in predetermined amounts to the emulsion, which was then mixed with stirring at 40° C and allowed to stand for 15 minutes. 250 g of the above emulsified product which was dissolved was added thereto, and further, 10 cc of a 1 wt% aqueous solution of 4-hydroxy-6-methyl-1,3,3a,7-tetrazaindene, 10 cc of a 1 wt% aqueous solution of 1-hydroxy-3,5-dichlorotriazine sodium salt and 10 cc of a 1 wt% aqueous solution of sodium dodecylbenzenesulfonate were successively added followed by stirring.

The finished emulsion was coated on a cellulose triacetate film base so as to provide a film thickness of 5 microns (dry basis) and then dried to obtain a sample of a light-sensitive material.

The film sample was cut into strips. One of the strips was subjected to optical wedge exposure using a sensitometer with a light source of a color temperature of 5400° K through a red filter (SC-56). The strip was then developed at 24° C for 10 minutes using a developer having the following composition, washed with water, hardened, washed with water and subjected to a second exposure for reversal in a conventional manner.

| Composition of the Developer | | |
|---|---|---|
| N-methyl-p-aminophenol (salt) | 4.5 | g |
| Hydroquinone | 4.5 | g |
| Sodium Sulfite (anhydrous) | 50 | g |
| Sodium Carbonate (monohydrate) | 30 | g |
| Potassium Bromide | 1 | g |
| Potassium Thiocyanate | 2 | g |
| Water to make | 1 | l |

Color development was then effected at 24° C for 15 minutes using a color developer having the following composition, followed by a conventional washing, bleaching, washing, fixing and washing to obtain a color positive image.

| Composition of the Color Developer | | |
|---|---|---|
| Benzyl Alcohol | 6 | ml |
| Sodium Sulfite (anhydrous) | 4 | g |
| Trisodium Phosphate | 40 | g |
| Sodium Hydroxide | 1.5 | g |
| Potassium Bromide | 0.5 | g |
| Ethylenediamine | 5 | ml |
| Citrazinic Acid | 1 | g |
| p-Amino-N-ethyl-N-β-methanesulfonamido-ethyl-m-toluidine Sulfate | 11 | g |
| Water to make | 1 | l |

The resulting strips were evaluated using a P-type densitometer made by Fuji Photo Film Co., Ltd. to obtain relative sensitivity and cyan color forming fog values. The standard point of the optical density to determine sensitivity was (fog + 0.50). The results obtained are shown in Table 1 as relative values.

TABLE 1

| Test No. | Sensitizing Dye and Amount (× $10^{-5}$ mol) | | | | $S_R$ | Fog |
|---|---|---|---|---|---|---|
| 1 | — | | — | | — | 0.07 |
| | (I-2) | 8 | — | | 100 | 0.07 |
| | — | | (II-1) | 2 | 48 | 0.07 |
| | — | | (II-1) | 4 | 88 | 0.07 |
| | (I-2) | 8 | (II-1) | 2 | 210 | 0.07 |
| | (I-2) | 8 | (II-1) | 4 | 250 | 0.07 |
| 2 | (I-4) | 8 | — | | 97 | 0.07 |
| | (I-4) | 8 | (II-3) | 2 | 160 | 0.07 |
| | (I-4) | 8 | (II-3) | 4 | 258 | 0.08 |
| | (I-4) | 8 | (II-3) | 8 | 318 | 0.09 |

The results of the Table 1 clearly show that a combination of cyanine dyes of the present invention exhibits a high supersensitization effect even when subjected to color development in the presence of a color coupler incorporated in a silver halide emulsion. Incidentally, in Test No. 2, a combination of Dye (I-4) (8 × $10^{-5}$ mol) and Dye (II-3) (8 × $10^{-5}$ mol) exhibited about a 1.6 times greater red sensitivity than that of the same dyes in single use.

EXAMPLE 2

The procedures described in Example 1 were repeated except for the use of the sensitizing dyes described hereinafter. The results obtained are shown in Tables 2 to 7 hereinbelow as relative values, wherein each standard is Test No. 1 of each Table.

TABLE 2

| Test No. | Sensitizing Dye and Amount (× $10^{-5}$ mol) | | | | $S_R$ | Fog | |
|---|---|---|---|---|---|---|---|
| A-1 | (I-2) | 8 | (II-1) | 2 | 100* | 0.07 | |
| A-2 | " | 8 | " | 4 | 120 | 0.07 | |
| A-3 | (Dye A) | 8 | (II-1) | 2 | 76 | 0.07 | (for comparison) |
| A-4 | " | 8 | " | 4 | 81 | 0.07 | " |
| A-5 | (Dye B) | 8 | (II-1) | 2 | 52 | 0.07 | " |
| A-6 | " | 8 | " | 4 | 57 | 0.08 | " |

*Standard

TABLE 3

| Test No. | Sensitizing Dye and Amount (× $10^{-5}$ mol) | | | | $S_R$ | Fog | |
|---|---|---|---|---|---|---|---|
| B-1 | (I-6) | 8 | (II-5) | 2 | 100* | 0.07 | |
| B-2 | " | 8 | " | 4 | 128 | 0.08 | |
| B-3 | (Dye C) | 8 | (II-5) | 2 | 70 | 0.07 | (for comparison) |
| B-4 | " | 8 | " | 4 | 83 | 0.08 | " |
| B-5 | (Dye D) | 8 | (II-5) | 2 | 49 | 0.08 | " |
| B-6 | " | 8 | " | 4 | 54 | 0.08 | " |

*Standard

TABLE 4

| Test No. | Sensitizing Dye and Amount (× $10^{-5}$ mol) | | | | $S_R$ | Fog | |
|---|---|---|---|---|---|---|---|
| C-1 | (I-7) | 8 | (II-2) | 2 | 100* | 0.07 | |
| C-2 | " | 8 | " | 4 | 135 | 0.07 | |
| C-3 | (Dye O) | 8 | (II-2) | 2 | 98 | 0.07 | |
| C-4 | " | 8 | " | 4 | 128 | 0.07 | |
| C-5 | (Dye E) | 8 | (II-2) | 2 | 65 | 0.07 | (for comparison) |
| C-6 | " | 8 | " | 4 | 74 | 0.08 | " |
| C-7 | (Dye F) | 8 | (II-2) | 2 | 54 | 0.08 | " |
| C-8 | " | 8 | " | 4 | 62 | 0.08 | " |

*Standard

TABLE 5

| Test No. | Sensitizing Dye and Amount (× $10^{-5}$ mol) | | | | $S_R$ | Fog | |
|---|---|---|---|---|---|---|---|
| D-1 | (I-1) | 8 | (II-1) | 2 | 100* | 0.07 | |
| D-2 | " | 8 | " | 4 | 126 | 0.07 | |
| D-3 | (Dye G) | 8 | (II-1) | 2 | 76 | 0.07 | (for comparison) |
| D-4 | " | 8 | " | 4 | 85 | 0.07 | " |
| D-5 | (Dye H) | 8 | (II-1) | 2 | 48 | 0.07 | " |
| D-6 | " | 8 | " | 4 | 53 | 0.08 | " |

*Standard

TABLE 6

| Test No. | Sensitizing Dye and Amount (× $10^{-5}$ mol) | | | | $S_R$ | Fog | |
|---|---|---|---|---|---|---|---|
| E-1 | (I-8) | 8 | (II-9) | 1 | 100* | 0.07 | |
| E-2 | " | 8 | " | 2 | 132 | 0.07 | |
| E-3 | (Dye J) | 8 | (II-9) | 1 | 79 | 0.07 | (for comparison) |
| E-4 | " | 8 | " | 2 | 83 | 0.08 | " |
| E-5 | (Dye K) | 8 | (II-9) | 1 | 45 | 0.08 | " |
| E-6 | " | 8 | " | 2 | 54 | 0.08 | " |

*Standard

TABLE 7

| Test No. | Sensitizing Dye and Amount (× $10^{-5}$ mol) | | | | $S_R$ | Fog | |
|---|---|---|---|---|---|---|---|
| F-1 | (I-9) | 8 | (II-13) | 2 | 100* | 0.07 | |
| F-2 | " | 8 | " | 4 | 118 | 0.07 | |
| F-3 | (Dye M) | 8 | (II-13) | 2 | 82 | 0.07 | (for comparison) |
| F-4 | " | 8 | " | 4 | 76 | 0.07 | " |
| F-5 | (Dye N) | 8 | (II-13) | 2 | 48 | 0.07 | " |
| F-6 | " | 8 | " | 4 | 45 | 0.08 | " |

*Standard

From the results shown in the above Tables, it is apparent that the supersensitizing combination of the dyes of the present invention gives rise to an unexpectedly superior $S_R$ in comparison with a combination using dyes as disclosed in the prior art, e.g., in U.S. Pat. No. 3,932,186.

EXAMPLE 3

A silver bromoiodide emulsion (having an iodide content of 8.5 mol%) was prepared by precipitating silver halide grains by the double jet method and subjecting the same to physical ripening, desalting and chemical ripening by conventional methods. The average diameter of the silver halide grains contained in this emulsion was 1.3 microns. This emulsion contained 0.74 mol of silver halide per kg of the emulsion.

80 g of a coupler was completely dissolved in a mixed solution of 100 cc of tricresyl phosphate and 100 cc of ethyl acetate. Further, 2 g of sorbitan monolaurate was dissolved therein. The resulting solution was added to 1 kg of a 10 wt% aqueous gelatin solution to which 2.5 g of dodecylbenzenesulfonic acid had been added as an aqueous solution, followed by high-speed stirring and supersonic agitation to obtain an emulsified product. 1 kg of the silver bromoiodide emulsion prepared was weighed and placed in a pot, and then dissolved on a constant temperature bath at 50° C.

Methanol solutions of sensitizing dyes were respectively added in predetermined amounts to the emulsion, which was then mixed with stirring at 40° C and allowed to stand for 15 minutes. 300 g of the above emulsified product which was dissolved was added thereto, and further, 10 cc of a 1 wt% aqueous solution of 4-hydroxy-6-methyl-1,3,3a,7-tetrazaindene, 10 cc of a 1 wt% aqueous solution of 1-hydroxy-3,5-dichlorotriazine sodium salt and 10 cc of a 1 wt% aqueous solution of sodium dodecylbenzenesulfonate were successively added followed by stirring.

The finished emulsion was coated on a cellulose triacetate film support so as to provide a film thickness of 5 microns on a dry basis, and, further, a protective layer mainly comprising gelatin was coated thereon so as to provide a film thickness of 1 micron on a dry basis and then dried to obtain a sample of a light-sensitive material.

The film sample was cut into strips. A set of the strips was subjected to optical wedge exposure using a sensitometer with a light source of a color temperature of 5400° K, a red filter (Fuji SC-56 filter) being attached to the sensitometer. The exposure condition was set to an illumination intensity of 256 lux and an exposure time of 1/20 second.

The above strips were developed at 38° C using the following color negative development procedure.

1. Color Development: 3 min and 15 sec
2. Bleaching: 6 min and 30 sec
3. Washing: 3 min and 15 sec
4. Fixing: 6 min and 30 sec
5. Washing: 3 min and 15 sec
6. Stabilizing: 3 min and 15 sec The processing solutions used for the above steps had the following compositions.

| | | |
|---|---|---|
| Color Developer | | |
| Sodium Nitrilotriacetate | 1.0 | g |
| Sodium Sulfite | 4.0 | g |
| Sodium Carbonate | 30.0 | g |
| Potassium Bromide | 1.4 | g |
| Hydroxylamine Sulfate | 2.4 | g |
| 4-(N-Ethyl-N-β-hydroxyethylamino)-2-methylaniline Sulfate | 4.5 | g |
| Water to make | 1 | l |
| Bleaching Solution | | |
| Ammonium Bromide | 160.0 | g |
| Aqueous Ammonia (28 wt %) | 25.0 | ml |
| Sodium Ethylenediaminetetraacetate Iron Salt | 130.0 | g |
| Glacial Acetic Acid | 14.0 | ml |
| Water to make | 1 | l |
| Fixing Solution | | |
| Sodium Tetrapolyphosphate | 2.0 | g |
| Sodium Sulfite | 4.0 | g |
| Ammonium Thiosulfate (70 wt % aq. soln.) | 175.0 | ml |
| Sodium Bisulfite | 4.6 | g |
| Water to make | 1 | l |
| Stabilizing Solution | | |
| Formaldehyde (38 wt % aq. soln.) | 8.0 | ml |
| Water to make | 1 | l |

The resulting strips were subjected to measurement using a P-type densitometer made by Fuji Photo Film Co., Ltd. to obtain relative sensitivity and cyan color forming fog values. The standard point of the optical density to determine the sensitivity was (fog + 0.20). The results obtained are shown in Tables 8 to 13 as relative values.

TABLE 8

(Coupler (A) was used)

| Test No. | Sensitizing Dye and Amount (× $10^{-5}$ mol) | | | | $S_R$ | Fog | |
|---|---|---|---|---|---|---|---|
| G-1 | — | | — | | — | 0.07 | |
| G-2 | (I-1) | 8 | — | | 100 | 0.07 | |
| G-3 | — | | (II-5) | 2 | 68 | 0.07 | |
| G-4 | — | | (II-5) | 4 | 140 | 0.07 | |
| G-5 | (I-1) | 8 | (II-5) | 2 | 195 | 0.07 | (for comparison) |
| G-6 | (I-1) | 8 | (II-5) | 4 | 224 | 0.07 | " |
| G-7 | — | | (II-1) | 2 | 50 | 0.07 | |
| G-8 | — | | (II-1) | 4 | 88 | 0.07 | |
| G-9 | (I-1) | 8 | (II-1) | 2 | 190 | 0.07 | (present invention) |
| G-10 | (I-1) | 8 | (II-1) | 4 | 240 | 0.07 | " |
| G-11 | (Dye G) | 8 | (II-1) | 2 | 152 | 0.07 | (for comparison) |
| G-12 | (Dye G) | 8 | (II-1) | 4 | 165 | 0.07 | " |
| G-13 | (Dye H) | 8 | (II-1) | 2 | 112 | 0.07 | " |
| G-14 | (Dye H) | 8 | (II-1) | 4 | 135 | 0.07 | " |

TABLE 9

(Combination of Coupler (A) and Coupler (B) was used, i.e., 10 mol % of Coupler (B) and 90 mol % of Coupler (A) was used and the total weight thereof was 80 g)

| Test No. | Sensitizing Dye and Amount ($\times 10^{-5}$ mol) | | | | $S_R$ | Fog | |
|---|---|---|---|---|---|---|---|
| H-1 | — | | — | | — | 0.08 | |
| H-2 | (I-2) | 8 | — | | 100 | 0.08 | |
| H-3 | — | | (II-9) | 1 | 62 | 0.08 | |
| H-4 | — | | (II-9) | 2 | 95 | 0.08 | |
| H-5 | (I-2) | 8 | (II-9) | 1 | 210 | 0.08 | (present invention) |
| H-6 | (I-2) | 8 | (II-9) | 2 | 228 | 0.08 | " |
| H-7 | (Dye A) | 8 | (II-9) | 1 | 144 | 0.08 | (for comparison) |
| H-8 | (Dye A) | 8 | (II-9) | 2 | 165 | 0.08 | " |
| H-9 | (Dye B) | 8 | (II-9) | 1 | 126 | 0.08 | " |
| H-10 | (Dye B) | 8 | (II-9) | 2 | 135 | 0.08 | " |

TABLE 10

(Coupler (C) was used)

| Test No. | Sensitizing Dye and Amount ($\times 10^{-5}$ mol) | | | | $S_R$ | Fog | |
|---|---|---|---|---|---|---|---|
| I-1 | — | | — | | — | 0.07 | |
| I-2 | (I-11) | 16 | — | | 100 | 0.07 | |
| I-3 | — | | (II-3) | 2 | 75 | 0.07 | |
| I-4 | — | | (II-3) | 4 | 156 | 0.07 | |
| I-5 | (I-11) | 16 | (II-3) | 2 | 186 | 0.07 | (present invention) |
| I-6 | (I-11) | 16 | (II-3) | 4 | 220 | 0.07 | " |
| I-7 | (Dye E) | 16 | (II-3) | 2 | 118 | 0.07 | (for comparison) |
| I-8 | (Dye E) | 16 | (II-3) | 4 | 162 | 0.07 | " |
| I-9 | (Dye F) | 16 | (II-3) | 2 | 105 | 0.08 | " |
| I-10 | (Dye F) | 16 | (II-3) | 4 | 156 | 0.08 | " |

TABLE 11

(Coupler (D) was used)

| Test No. | Sensitizing Dye and Amount ($\times 10^{-5}$ mol) | | | | $S_R$ | Fog | |
|---|---|---|---|---|---|---|---|
| J-1 | — | | — | | — | 0.07 | |
| J-2 | (I-10) | 8 | — | | 100 | 0.07 | |
| J-3 | (I-10) | 16 | — | | 132 | 0.07 | |
| J-4 | — | | (II-13) | 8 | 140 | 0.07 | |
| J-5 | (I-10) | 8 | (II-13) | 8 | 215 | 0.07 | (present invention) |
| J-6 | (I-10) | 16 | (II-13) | 8 | 224 | 0.07 | " |
| J-7 | (Dye P) | 8 | (II-13) | 8 | 170 | 0.07 | (for comparison) |
| J-8 | (Dye P) | 16 | (II-13) | 8 | 175 | 0.07 | " |
| J-9 | (Dye Q) | 8 | (II-13) | 8 | 136 | 0.07 | " |
| J-10 | (Dye Q) | 16 | (II-13) | 8 | 160 | 0.07 | " |

TABLE 12

(Coupler (E) was used)

| Test No. | Sensitizing Dye and Amount ($\times 10^{-5}$ mol) | | | | $S_R$ | Fog | |
|---|---|---|---|---|---|---|---|
| K-1 | — | | — | | — | 0.07 | |
| K-2 | (I-6) | 8 | — | | 100 | 0.07 | |
| K-3 | — | | (II-22) | 8 | 178 | 0.07 | |
| K-4 | (I-6) | 8 | (II-22) | 8 | 220 | 0.07 | (present invention) |
| K-5 | (I-6) | 16 | (II-22) | 8 | 232 | 0.07 | " |
| K-6 | (Dye C) | 8 | (II-22) | 8 | 185 | 0.07 | (for comparison) |
| K-7 | (Dye C) | 16 | (II-22) | 8 | 191 | 0.07 | " |
| K-8 | (Dye D) | 8 | (II-22) | 8 | 154 | 0.07 | " |
| K-9 | (Dye D) | 16 | (II-22) | 8 | 166 | 0.07 | " |

TABLE 13

(Combination of Coupler (F) and Coupler (A) was used, i.e., 5 mol % of Coupler (F) and 95 mol % of Coupler (A) were used in total amount of 80 g)

| Test No. | Sensitizing Dye and Amount ($\times 10^{-5}$ mol) | | | | $S_R$ | Fog | |
|---|---|---|---|---|---|---|---|
| L-1 | — | | — | | — | 0.07 | |
| L-2 | (I-9) | 8 | — | | 100 | 0.07 | |
| L-3 | (I-9) | 16 | — | | 132 | 0.07 | |
| L-4 | — | | (II-15) | 4 | 69 | 0.07 | |

TABLE 13-continued (Combination of Coupler (F) and Coupler (A) was used, i.e., 5 mol % of Coupler (F) and 95 mol % of Coupler (A) were used in total amount of 80 g)

| Test No. | Sensitizing Dye and Amount ($\times 10^{-5}$ mol) | | | | $S_R$ | Fog | |
|---|---|---|---|---|---|---|---|
| L-5 | (I-9) | 8 | (II-15) | 4 | 147 | 0.07 | (present invention) |
| L-6 | (I-9) | 16 | (II-15) | 4 | 154 | 0.07 | " |
| L-7 | (Dye M) | 8 | (II-15) | 4 | 116 | 0.07 | (for comparison) |
| L-8 | (Dye M) | 16 | (II-15) | 4 | 123 | 0.07 | " |
| L-9 | (Dye N) | 8 | (II-15) | 4 | 95 | 0.07 | " |
| L-10 | (Dye N) | 16 | (II-15) | 4 | 111 | 0.08 | " |

From the results shown in the above Tables, it is apparent that the supersensitizing combination of dyes of the present invention gives rise to an unexpectedly superior $S_R$ in comparison with a combination using dyes as disclosed in the prior art, e.g., U.S. Pat. No. 3,932,186.

While the invention has been described in detail and with reference to specific embodiments thereof, it will be apparent to one skilled in the art that various changes and modifications can be made without departing from the spirit and scope thereof.

What is claimed is:

1. A supersensitized silver halide photographic emulsion containing a cyan coupler and, in combination, one of the sensitizing dyes represented by the following general formula (I) and at least one of the sensitizing dyes represented by the general formula (II):

General Formula (I)

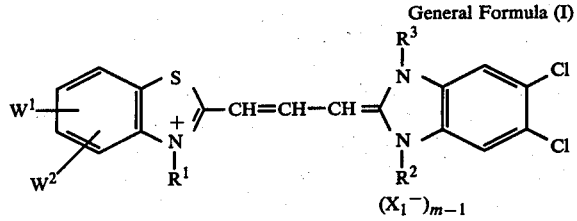

wherein $W^1$ and $W^2$ each represents a hydrogen atom, an alkyl group, an alkoxyl group, a halogen atom, an alkoxycarbonyl group, an acyl group or an aryl group; $R^1$ and $R^2$ each represents a sulfoalkyl group; $R^3$ represents an alkyl group or an allyl group; $X_1$ represents an acid anion; and $m$ is 1 or 2, $m$ being 1 in case that the dye forms an inner salt of a betaine-like structure;

General Formula (II)

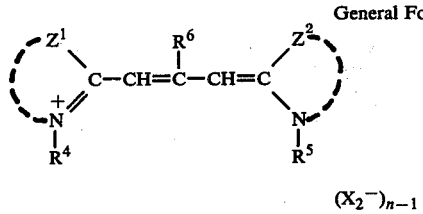

wherein $Z^1$ and $Z^2$ each represents an atomic group required for forming a benzothiazole nucleus, a benzoselenazole nucleus, a $\beta$-naphthothiazole nucleus or a $\beta$-naphthoselenazole nucleus; $R^4$ and $R^5$ each represents an aliphatic group and at least one of $R^4$ and $R^5$ represents a carboxylakyl group or a sulfoalkyl group; $R^6$ represents an alkyl group, an aryl group, a thienyl group or a furyl group; $X_2$ represents an acid anion; and $n$ is 1 or 2, $n$ being 1 in the case that the dye forms an inner salt of a betaine-like structure, wherein said cyan coupler is a cyan coupler represented by the general formula (III) or (IV):

General Formula (III)

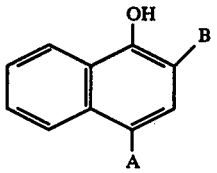

General Formula (IV)

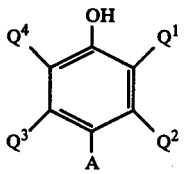

wherein B represents a carbamyl group, a sulfamyl group, an alkoxycarbonyl group or an aryloxycarbonyl group; $Q^1$ represents an alkyl group, an aryl group, an amino group, a carbonamido group, a sulfonamido group, a sulfamyl group or a carbamyl group; $Q^2$, $Q^3$ and $Q^4$ each represents the groups as defined for Qand further a halogen atom or an alkoxy group; and A represents a hydrogen atom or a group releasable at color development selected from the class consisting of a halogen atom, an indazolyl group, a cyclic imido group, an acyloxy group, an aryloxy group, an alkoxy group, a sulfo group, an arylazo group, a heterocyclic azo group, an arylmonothio group, a heterocyclic thio group, a 1-benzotriazolyl group or a 1-benzodiazolyl group.

2. The supersensitized silver halide photographic emulsion as claimed in claim 1, wherein said coupler is at least one of 1-hydroxy-4-maleimide-2-naphthamide, 1-hydroxy-N-[γ-(2,4-di-tert-amylphenoxypropyl)]-2-naphthamide, 1-hydroxy-4-[2-(2-hexyldecyloxycarbonyl)phenylazo]-2-[N-(1-naphthyl)]naphthamide, 1-hydroxy-4-chloro-N-[α-(2,4-di-tert-amylphenoxy)-butyl]-2-naphthamide, 1-hydroxy-4-iodo-N-dodecyl-2-naphthamide, 5-methyl-4,6-dichloro-2-[α-(3-n-pentadecylphenoxy)butyramido]phenol or 5-methoxy-2-[α-(3-n-pentadecylphenoxy)butyramido]-4-(1-phenyl-5-tetrazolythio)phenol.

3. The supersensitized silver halide photographic emulsion as claimed in claim 1, wherein in general formula (II), $R^4$ and $R^5$ are each selected from the group consisting of a sulfoalkyl group and a carboxyalkyl group, and $R^6$ is a methyl group, an ethyl group or a phenyl group.

4. The supersensitized silver halide photographic emulsion as claimed in claim 1, wherein $Z^1$ and $Z^2$ in general formula (II) are each selected from the group consisting of benzothiazole nuclei having a hydrogen atom, a chlorine atom, a methyl group or a methoxy group in the 5-position.

5. The supersensitized silver halide photographic emulsion as claimed in claim 1, wherein $Z^1$ and $Z^2$ in general formula (II) are β-naphthothiazole nuclei.

6. The supersensitized silver halide photographic emulsion as claimed in claim 4, wherein the dye of general formula (I) and the dye of general formula (II) are present in a molar ratio of about 10:1 to about 1:20.

7. The supersensitized silver halide photographic emulsion as claimed in claim 5, wherein the dye of general formula (I) and the dye of general formula (II) are present in a molar ratio of about 2:1 to about 1:10.

8. The supersensitized silver halide photographic emulsion as claimed in claim 1, wherein $Z^1$ and $Z^2$ in general formula (II) are benzoselenozle nuclei.

9. A method for supersensitizing a silver halide photographic emulsion which comprises incorporation into said emulsion at least one dye of general formula (I) as defined below and, combined therewith, one by of general formula (II) as defined below, wherein said emulsion further contains a cyan coupler represented by general formula (III) or (IV):

General Formula (I)

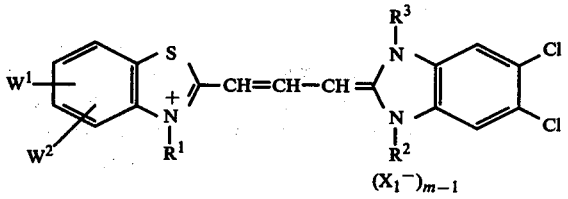

wherein $W^1$ and $W^2$ each represents a hydrogen atom, an alkyl group, an alkoxy group, a halogen atom, an alkoxycarbonyl group, an acyl group or an aryl group; $R^1$ and $R^2$ each represents a sulfoalkyl group; $R^3$ represents an alkyl group or an allyl group; $X_1$ represents an acid anion; and *m* is 1 or 2, *m* being 1 in the case that the dye forms an inner salt of a betaine-like structure;

General Formula (II)

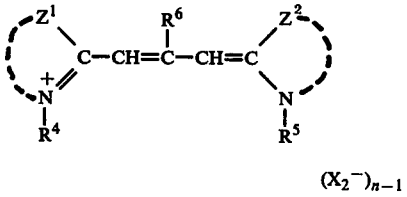

wherein $Z^1$ and $Z^2$ each represents an atomic group required for forming a benzothiazole nucleus, a benzoselenazole nucleus, a β-naphthothiazole nucleus or a β-naphthoselenazole nucleus; $R^4$ and $R^5$ each represents an aliphatic group and at least one of $R^4$ and $R^5$ represents a carboxyalkyl group or a sulfoalkyl group; $R^6$ represents an alkyl group, an aryl group, a thienyl group or a furyl group; $X_2$ represents an acid anion; and *n* is 1 or 2, *n* being 1 in the case that the dye forms an inner salt of a betaine-like structure, General Formula (III)

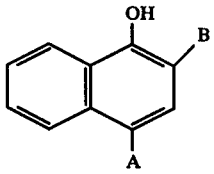

-continued

General Formula (IV)

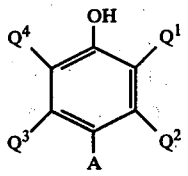

wherein B represents a carbamyl group, a sulfamyl group, an alkoxycarbonyl group or an aryloxycarbonyl group; $Q^1$ represents an alkyl group, an aryl group, an amino group, a carbonamido group, a sulfonamido group, a sulfamyl group or a carbamyl group; $Q^2$, $Q^3$ and $Q^4$ each represents the groups as defined for $Q^1$ and further a halogen atom or an alkoxy group; and A represents a hydrogen atom or a group releasable at color development selected from the class consisting of a halogen atom, an indazolyl group, a cyclic imido group, an acyloxy group, an aryloxy group, an alkoxy group, a sulfo group, an arylazo group, a heterocyclic azo group, an arylmonothio group, a heterocyclic thio group, a 1-benzotriazolyl group or a 1-benzodiazolyl group.

10. A method of supersensitizing a silver halide photographic emulsion as claimed in claim 9, wherein said dye of general formula (II) is represented by the general formula (II-3):

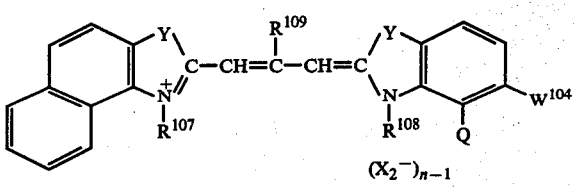

wherein, Y represents a sulfur atom or a selenium atom; $W^{104}$ represents a hydrogen atom, an alkyl group, an alkoxyl group or a halogen atom; Q represents a hydrogen atom or may form a benzene nucleus in conjunction with $W^{104}$; $R^{109}$ represents a methyl group, an ethyl group, a propyl group or a phenyl group; $R^{107}$ and $R^{108}$ each represents a carboxyalkyl group or a sulfoalkyl group; $n$ is 1 or 2; and $X_2$ represents an acid anion.

* * * * *